United States Patent [19]

Vogelsberg

[11] 4,122,808

[45] Oct. 31, 1978

[54] IGNITION TIMING CONTROL

[75] Inventor: William A. Vogelsberg, Yale, Mich.

[73] Assignee: General Motors Corporation, Detroit, Mich.

[21] Appl. No.: 785,778

[22] Filed: Apr. 8, 1977

[51] Int. Cl.[2] ..... F02P 5/10; F02M 25/06

[52] U.S. Cl. ..... 123/117 A; 123/119 A

[58] Field of Search ..... 123/117 A, 119 A

[56] References Cited

U.S. PATENT DOCUMENTS

| | | | |
|---|---|---|---|
| 2,141,029 | 12/1938 | Bohli | 123/117 A |
| 2,470,366 | 5/1949 | Ostling | 123/117 A |
| 3,812,832 | 5/1974 | Scott | 123/119 A |
| 3,834,366 | 9/1974 | Kingsbury | 123/119 A |
| 3,880,129 | 4/1975 | Hollis | 123/119 A |
| 3,915,132 | 10/1975 | Thornburgh | 123/117 A |
| 3,982,515 | 9/1976 | Bradshaw | 123/119 A |

*Primary Examiner*—Carlton R. Croyle
*Assistant Examiner*—Michael Koczo, Jr.
*Attorney, Agent, or Firm*—C. K. Veenstra

[57] ABSTRACT

Ignition timing and exhaust gas recirculation vary with exhaust pressure over one range of engine operation, while in a second range of operation ignition timing varies with induction passage pressure and exhaust gas recirculation varies with both induction passage pressure and exhaust pressure.

2 Claims, 1 Drawing Figure

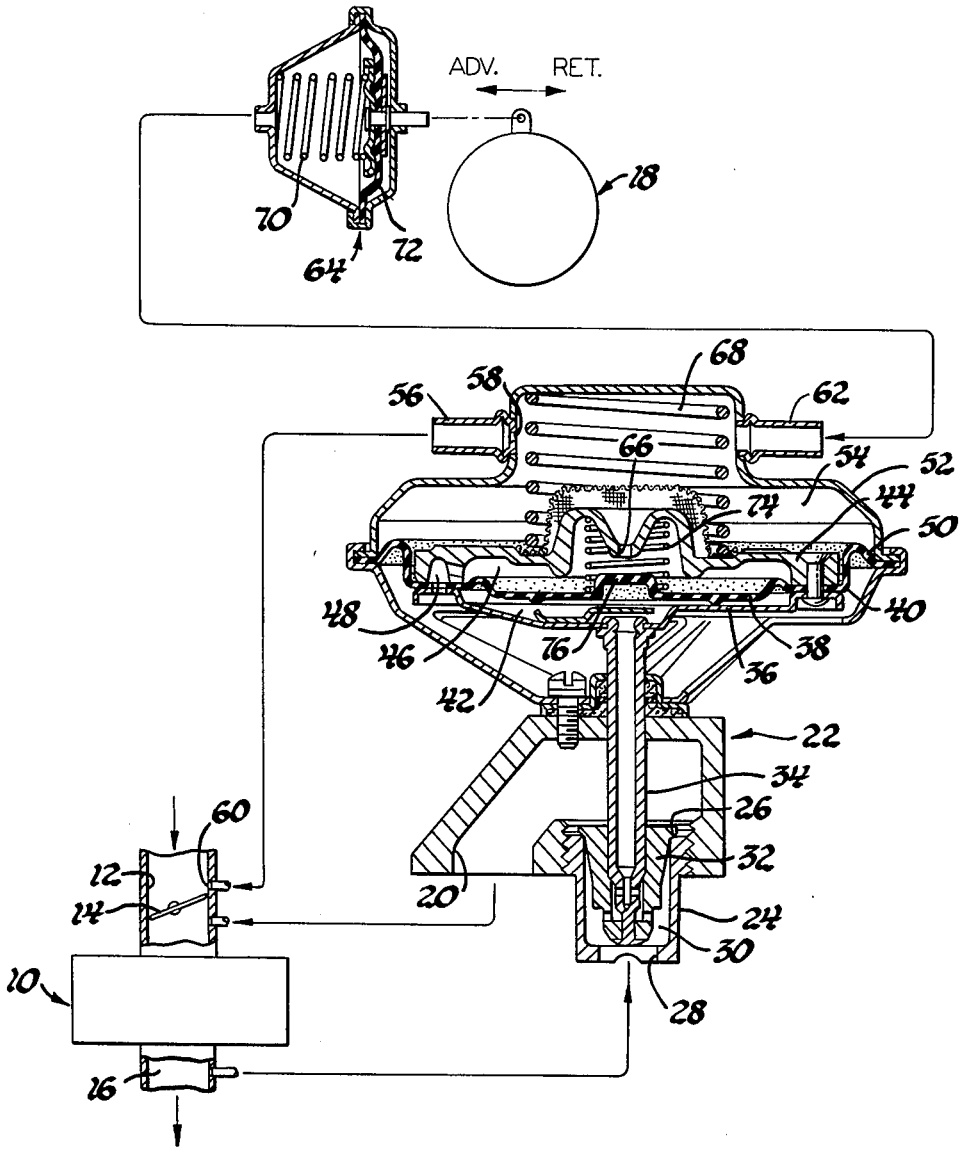
ADV.
RET.
18
70
72
64
68
56
58
62
66
54
52
74
44
50
48
40
46
76
38
36
42
22
34
26
60
12
32
14
20
24
30
10
28
16

IGNITION TIMING CONTROL

This invention relates to an ignition timing control for an internal combustion engine, and more particularly, to an ignition timing control which responds to pressure in an exhaust passage over one range of engine operation and to pressure in an induction passage over another range of engine operation.

Innumerable systems have been suggested for controlling ignition timing in an internal combustion engine. In common practice, the timing advances with decreases in pressure in the induction passage downstream of the throttle. Another proposal has superimposed timing advance in response to an increase in exhaust pressure upon timing advance in response to a decrease in induction pressure. Yet another proposal has varied ignition timing in response to a pressure resulting from averaging the exhaust pressure and the induction pressure. While such systems may be satisfactory in many applications, they do not provide the desired correlation between ignition timing and engine operating conditions in certain applications.

This invention provides an ignition timing control which advances the timing with increases in exhaust pressure over a range of exhaust pressures up to an established exhaust pressure level and which advances the timing with decreases in induction pressure when the exhaust pressure exceeds the established level. These control modes are achieved by subjecting an ignition timing control motor to subatmospheric induction passage pressure and varying flow through an air bleed into the motor in accordance with exhaust pressure to create a subatmospheric control pressure which decreases with increases in exhaust pressure up to the established exhaust pressure level and which thereafter varies with variations in the induction passage pressure. Ignition timing accordingly will be advanced as engine air flow increases up to a selected engine air flow, will continue to be advanced if engine load and induction passage pressure decrease at air flows above the selected air flow, and will be retarded as the engine throttle nears its wide open position and induction passage pressure approaches atmospheric pressure. Moreover, when induction passage pressure is sensed at a port which is upstream of the throttle when the throttle is closed, ignition timing also will be retarded during closed throttle operation.

In its preferred embodiment, this ignition timing control is combined with an exhaust gas recirculation control which responds to the control pressure signal. The indicated exhaust pressure is sensed in the zone of a recirculation passage downstream of an orifice, and the exhaust gas recirculation control maintains the zone pressure constant over the range of exhaust pressures up to the established exhaust pressure level to recirculate exhaust gases in proportion to engine air flow.

The details as well as other features and advantages of this invention are set forth in the remainder of the specification and are shown in the drawing which schematically illustrates an engine having an ignition timing control embodying this invention.

Referring to the drawing, an internal combustion engine 10 has an air induction passage 12 controlled by a throttle 14, an exhaust passage 16, and a distributor 18 for effecting ignition. An exhaust gas recirculation (hereinafter abbreviated EGR) passage 20 extends from exhaust passage 16 through an ERG valve assembly 22 to induction passage 12 downstream of throttle 14.

A member 24 is disposed in EGR passage 20 at the inlet to EGR valve assembly 22 and forms a valve seat 26, an orifice 28, and a zone 30 between valve seat 26 and orifice 28. An EGR valve member 32 controls flow through valve seat 26 and is mounted on a hollow stem 34 carried by a diaphragm backing plate 36. The inner portion 38 of a diaphragm 40 forms a pressure responsive transducer member enclosing a chamber 42 above plate 36 which is subjected to the pressure in zone 30 through hollow valve stem 34. A dished member 44 defines a chamber 46 above transducer member 38 which is exposed to atmospheric pressure through a plurality of openings 48.

The outer portion 50 of diaphragm 40 forms an actuator which carries plate 36 and dished member 44 and thus positions valve stem 34 and valve member 32. A cover 52 is disposed above actuator 50 to define a control pressure region 54 therebetween. Cover 52 has a fitting 56, including an orifice 58, which senses the pressure in induction passage 12 at a port 60 disposed upstream of throttle 14 when throttle 14 is closed and downstream of throttle 14 when throttle 14 is open.

Cover 52 also has a fitting 62 for transmitting the control pressure in region 54 to a vacuum motor 64 which adjusts distributor 18 to control the timing of ignition.

In operation, as throttle 14 is opened the subatmospheric induction passage pressure downstream thereof is transmitted to control pressure region 54. However, an air bleed 66 opening through dished member 44 allows air flow from atmospheric pressure chamber 46 into control pressure region 54 to increase the pressure therein. Accordingly, a spring 68 biases actuator 50 downwardly to engage EGR valve member 32 with valve seat 26, and a spring 70 within vacuum motor 64 biases a diaphragm 72 within vacuum motor 64 to retard the ignition timing. Now as the pressure in exhaust passage 16 and zone 30 rises, transducer member 38 is lifted against the bias of a spring 74 and a bleed valve member 76 carried by transducer member 38 reduces air flow through bleed 66. The resulting reduction in the control pressure in region 54 lifts actuator 50 against the bias of spring 68 to displace EGR valve member 32 from valve seat 26 and allow recirculation of exhaust gases through EGR passage 20; simultaneously, diaphragm 72 is retracted against the bias of spring 70 to advance the ignition timing.

Upon a reduction in load for any selected position of throttle 14, flow through induction passage 12 and exhaust passage 16 is reduced and the pressure in zone 30 drops. Spring 74 then displaces transducer member 38 and bleed valve member 76 to allow increased air flow through bleed 66 into region 54. The resulting increase in control pressure in region 54 allows spring 68 to displace actuator 50 downwardly to move EGR valve member 32 toward valve seat 26 to reduce recirculation of exhaust gases through EGR passage 20; simultaneously spring 70 displaces diaphragm 72 to retard the ignition timing.

Variations in engine operating conditions which cause a change in induction passage pressure at port 60 without causing a change in pressure in zone 30 will not result in a change in the rate of recirculation of exhaust gases through EGR passage 20 or in the ignition timing under certain circumstances. For example, as the pressure at port 60 drops causing a decrease in the control pressure in region 54, actuator 50 will tend to be drawn upwardly against the bias of spring 68 to displace EGR valve member 32 further from seat 26. However, such action would reduce the pressure in zone 30 allowing spring 74 to displace pressure transducer member 38 and bleed valve member 76 away from bleed 66. The increased air flow through bleed 66 into control pressure region 54 will increase the control pressure until the pressure in zone 30 is restored.

On the other hand, variations in engine operating conditions which cause a change in pressure in exhaust passage 16 will result in a change in the rate of recirculation of exhaust gases and in the ignition timing. As the engine air flow decreases, the pressure in exhaust passage 16 and zone 30 decreases and transducer member 38 is lowered by spring 74. Bleed valve member 76 allows additional air flow through bleed 66 to increase the control pressure in region 54. Actuator 50 is lowered by spring 68 to move EGR valve member 24 closer to seat 26, thus reducing recirculation of exhaust gases to maintain a substantially constant pressure in zone 30 and thereby maintain recirculation of exhaust gases in substantially constant proportion to engine air flow. Simultaneously, vacuum motor 64 follows the increase in control pressure to retard the ignition timing.

However, should the pressure in zone 30 rise so that the bias of spring 74 is completely overcome and transducer member 38 holds bleed valve member 76 against bleed 66, actuator 50 and diaphragm 72 will respond to changes in induction passage vacuum at port 60. It will be appreciated that springs 68 and 70 and the travel of actuator 50 and diaphragm 72 are selected so that EGR valve member 32 may be fully displaced from its valve seat 26 while diaphragm 72 still has sufficient travel to respond to variations in induction passage pressure.

It also will be appreciated that when throttle 14 is closed as shown, control pressure region 54 senses the substantially atmospheric pressure upstream of throttle 14 and EGR valve assembly 22 inhibits recirculation of exhaust gas while vacuum motor 64 retards the ignition timing. Moreover, during wide open throttle operation the induction passage pressure at port 60 approaches atmospheric pressure so EGR valve assembly 22 inhibits recirculation of exhaust gases and vacuum motor 64 retards the ignition timing.

It will be appreciated that various vacuum signal control valves could be included in the lines between fitting 56 and port 60 and/or between fitting 62 and vacuum motor 64. Moreover, transducer member 38 could be formed as a component separate from EGR valve assembly 22 — with air bleed 66 opening directly to vacuum motor 64 and through vacuum motor 64 to control pressure region 54 in EGR valve assembly 22 or with air bleed 66 opening directly to both vacuum motor 64 and control pressure region 54. Such a modification would permit vacuum signal control valves to affect the control pressure delivered to region 54 independently of the control pressure delivered to vacuum motor 64.

The embodiments of the invention in which an exclusive property or privilege is claimed are defined as follows:

1. An ignition timing control assembly for an internal combustion engine having an exhaust passage and means for effecting ignition, said ignition timing control assembly comprising means forming a pressure region and a motor for adjusting said ignition effecting means to advance the timing of ignition in inverse relation to the pressure in said region, said region having an orifice for sensing a subatmospheric pressure and a bleed for sensing atmospheric pressure, a valve member for varying air flow through said bleed to control the pressure in said region, and means responsive to variations in pressure in said exhaust passage for positioning said valve member whereby said valve member reduces flow through said bleed upon an increase in the exhaust passage pressure to reduce the control pressure and cause said motor to advance the timing of ignition and increases flow through said bleed upon a decrease in the exhaust passage pressure to increase the control pressure and cause said motor to retard the timing of ignition.

2. An ignition timing control for an internal combustion engine having means for effecting ignition, an induction passage, an exhaust passage, a recirculation passage extending from said exhaust passage to said induction passage, a recirculation valve member disposed in said recirculation passage for controlling flow therethrough, a pressure responsive transducer member for sensing the pressure in a zone of said recirculation passage upstream of said recirculation valve member, a control pressure region for sensing a subatmospheric pressure created in said induction passage, an air bleed opening into said region, a bleed valve member positioned by said transducer member to control air flow through said air bleed into said region in accordance with the pressure in said zone and thereby create a control pressure in said region which varies inversely with the pressure in said zone, and means responsive to the control pressure in said region for positioning said recirculation valve member to increase flow through said recirculation passage upon a decrease in the control pressure and to decrease flow through said recirculation passage upon an increase in the control pressure and thereby maintain a substantially constant pressure in said zone, said ignition timing control comprising means responsive to the control pressure in said region for adjusting said ignition effecting means to advance the timing of ignition upon a decrease in the control pressure and to retard the timing of ignition upon an increase in the control pressure.

* * * * *